US006745988B2

(12) United States Patent
Gelfand

(10) Patent No.: US 6,745,988 B2
(45) Date of Patent: Jun. 8, 2004

(54) WORKSTATION ATTACHMENT FOR FRENCH EASEL

(76) Inventor: Daniel Gelfand, 200 Winston Dr., Apt. 1918, Cliffside Park, NJ (US) 07010

( * ) Notice: Subject to any disclaimer, the term of this patent is extended or adjusted under 35 U.S.C. 154(b) by 0 days.

(21) Appl. No.: 10/233,855

(22) Filed: Sep. 3, 2002

(65) Prior Publication Data

US 2004/0041068 A1 Mar. 4, 2004

(51) Int. Cl.[7] ..... A47B 97/04
(52) U.S. Cl. ..... 248/460
(58) Field of Search ..... 248/460, 441.1, 248/444, 447, 448, 463; 312/231, 235.4; 108/26, 50.17, 42, 50.11, 3, 11

(56) References Cited

U.S. PATENT DOCUMENTS 2,586,524 A * 2/1952 Dussardier ..... 312/231
2,739,863 A * 3/1956 Ferris ..... 312/231
2,808,308 A * 10/1957 Papelian et al. ..... 312/231
3,202,471 A * 8/1965 Wilson ..... 312/231
3,476,456 A * 11/1969 Canavan ..... 312/231
3,669,227 A * 6/1972 Alford ..... 190/11
4,149,763 A 4/1979 Delahaie ..... 312/231
4,372,630 A 2/1983 Fuhri ..... 312/231
4,723,821 A * 2/1988 Montgomery ..... 312/231
4,856,856 A * 8/1989 Winstone ..... 206/756
5,337,996 A 8/1994 Kalish ..... 248/460
5,860,518 A 1/1999 Axelrod ..... 206/224
5,899,429 A * 5/1999 McCloud ..... 248/441.1
6,012,696 A 1/2000 Borie ..... 248/461
6,394,567 B1 * 5/2002 Welch ..... 312/334.41

* cited by examiner

*Primary Examiner*—Korie Chan
*Assistant Examiner*—A. Joseph Wujciak
(74) *Attorney, Agent, or Firm*—Herbert Dubno

(57) ABSTRACT

A workstation for a portable easel, especially a French easel, has hinged tray halves which, when open, have slides which engage the sides of the easel drawer from the exterior and thus hold the tray open so that the tray does not obstruct access to the interior of the drawer while providing a place to rest a palette. On the other side, the tray may form a brush rack and towel holder.

12 Claims, 6 Drawing Sheets

WORKSTATION ATTACHMENT FOR FRENCH EASEL

FIELD OF THE INVENTION

The present invention relates to a workstation attachment for a portable easel, more particularly, to a so-called French easel of the type which has a drawer and a workstation attachment which fits onto that drawer.

BACKGROUND OF THE INVENTION

A common portable easel, primarily for use outdoors, by painters, water colorists and other artists is known variously as the "French easel", the "Jullian easel" or the "box-type easel". This widely-used easel has the advantage of being compact, since the legs of the easel and the artwork support fold into the frame which is rectangular and has a box configuration. The easel usually also has a drawer which is pulled out in the direction of the artist once the easel is erected and is in use. Such easels have been described and illustrated in commercial literature and, reference may be had to the May 2002 issue of American Artist, which shows a metal shelf which is attached laterally to the easel and is marketed by G. Hemson Fine Art of Manitou Springs, Colo. 80829. That surface, laterally of the easel, serves to support a palette, towels, supplies, etc.

Another system for increasing the surface area available for use by the artist is that which has been described as the "French Companion" or "French Mistress" which is a folding tray which rests upon the aforementioned easel drawer and has surfaces above the drawer and laterally of the drawer to either side.

The side shelf, while providing a substantial area, is predominantly at a location which cannot readily be reached by an artist in front of the easel and the folding tray which rests upon the drawer obstructs the interior of the drawer and thus provides additional work surfaces but only at the expense of the storage capacity of the drawer. Various other solutions to problems with French easels are found in U.S. Pat. Nos. 4,149,463, 5,337,996 and 6,012,696. Reference may also be had to U.S. Pat. Nos. 5,372,630 and 5,860,318.

OBJECTS OF THE INVENTION

It is the principal object of the present invention, therefore, to provide a workstation attachment for a French easel which can have augmented work surfaces without detracting from the utility of the drawer.

Another object of this invention is to provide a workstation for a French easel which can be simply attached thereto, which will provide additional working surfaces and facilities, and which when removed, is itself compact and easy to handle.

SUMMARY OF THE INVENTION

These objects and others which will become apparent hereinafter are attained, in accordance with the present invention, in a workstation attachment for a French easel which provides a platform for a palette on one side and, on the other side, brush racks, a support for a paper towel holder and space for jars, solvents and other accessories useful to the artist.

Key to the invention is that this workstation has a pair of slides which engage the sides of the drawer from the exterior so that the workstation underlies the drawer between those slides and therefore does not obstruct the drawer. The workstation can project toward the artist forwardly of the drawer and there provides a shelf for the storage of additional paraphernalia useful to the artist. More particularly, the easel assembly of the invention can comprise:

- a box-shaped casing;
- a plurality of folding legs mounted on and extendable from the casing for supporting the casing upon a surface;
- an artwork support structure mounted on and erectable from the casing for supporting an artist's work surface;
- a drawer receivable in the casing and extendable therefrom in a direction transverse to the surface and toward a user of the easel, the drawer having a pair of longitudinal sides extending in the direction; and
- a workstation attachment for the easel comprising:
  - an elongated tray dimensioned to extend below the drawer and beyond the sides, and
- a pair of slides on the tray engaging the sides of the drawer and supporting the tray on the drawer.

As noted, a pair of brush racks can be mounted on one end of a tray to one side of the drawer while another end of the tray forms a palette receiving surfaces of the opposite end of the drawer.

The tray itself can have two parts and thus can fold at a hinge between those parts.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
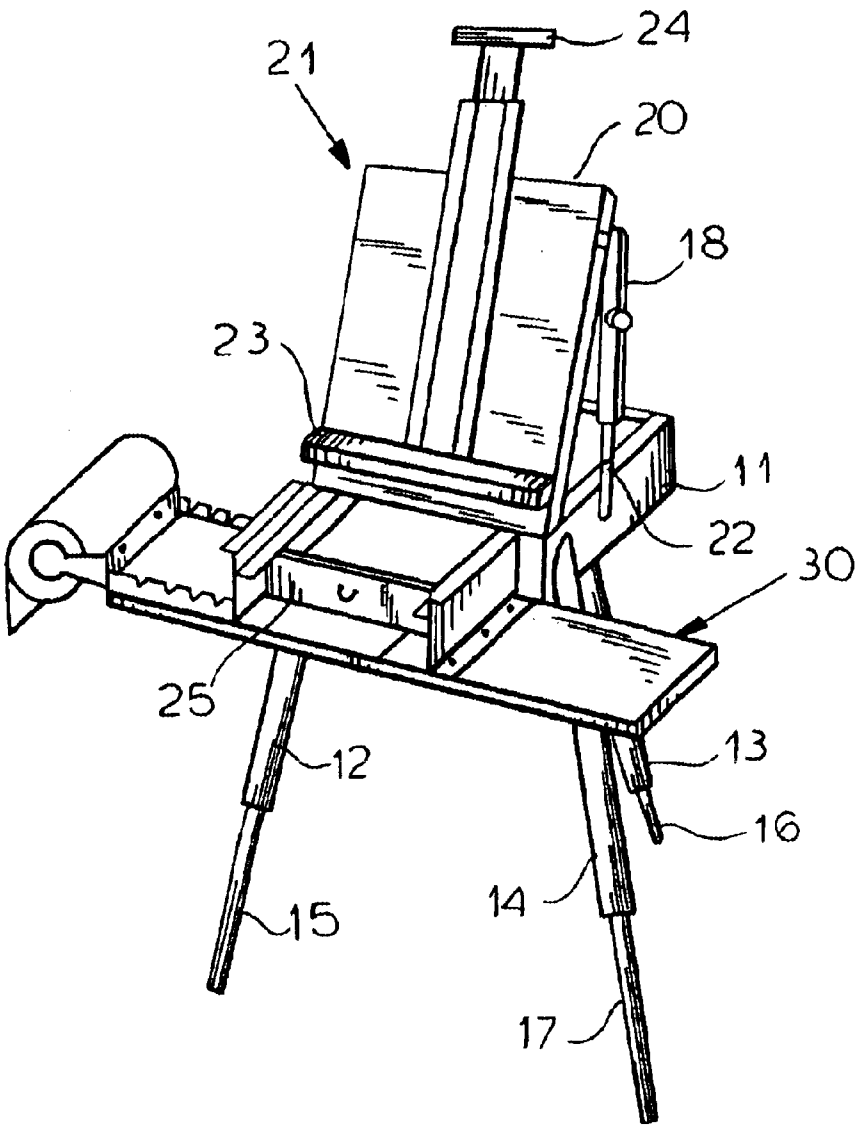
FIG. 1 is a perspective view of a French easel with the workstation of the present invention in place.

As can be seen from FIG. 1, a French, Jullian or box portable easel 10 can comprise a box frame 11 from which legs 12, 13 and 14 can be swung downwardly to support the easel on the ground. Each of the legs 12–14 is of a telescoping type and has an inner member 15, 16, 17 which is adjustable along the leg so that the easel can be set on irregular ground and even stabilized by forcing one of the members 15, 16, 17 into the ground as may be desired. The superstructure of the easel, referred to herein as the artwork support, is swingably mounted on the frame 11 and may be held erect by an extensible strut 18 which can be pivotally connected at 19 to a board 20 of the artwork support 21 and at a pivot 22 to the frame. The artwork support may have a ledge 23 upon which a canvas or paper sheet or board is mounted and a vertically shiftable holder 24 which can engage the canvas from above. A drawer 25 can be pulled out of the frame 11 and can hold bottles, jars, brushes and other paraphernalia necessary to the artist. The drawer 25 has a pull 26, a pair of opposite longitudinal sides 27 and 28 and a bottom 29. The drawer may be formed internally with partitions 30 (see FIG. 3).

Figure 4:
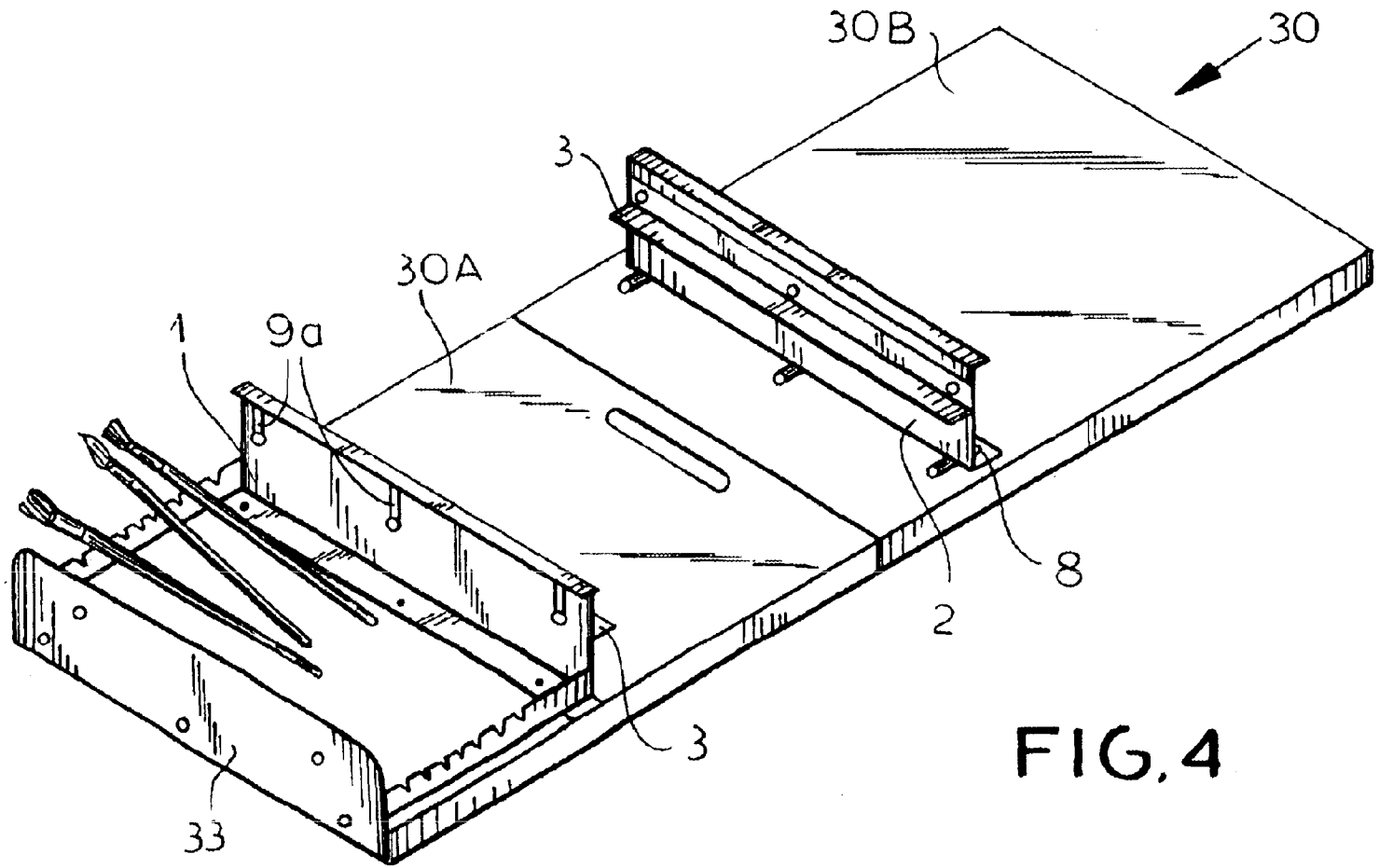
FIG. 4 is a view similar to FIG. 2 of the workstation but without the towel holder.
Figure 5:
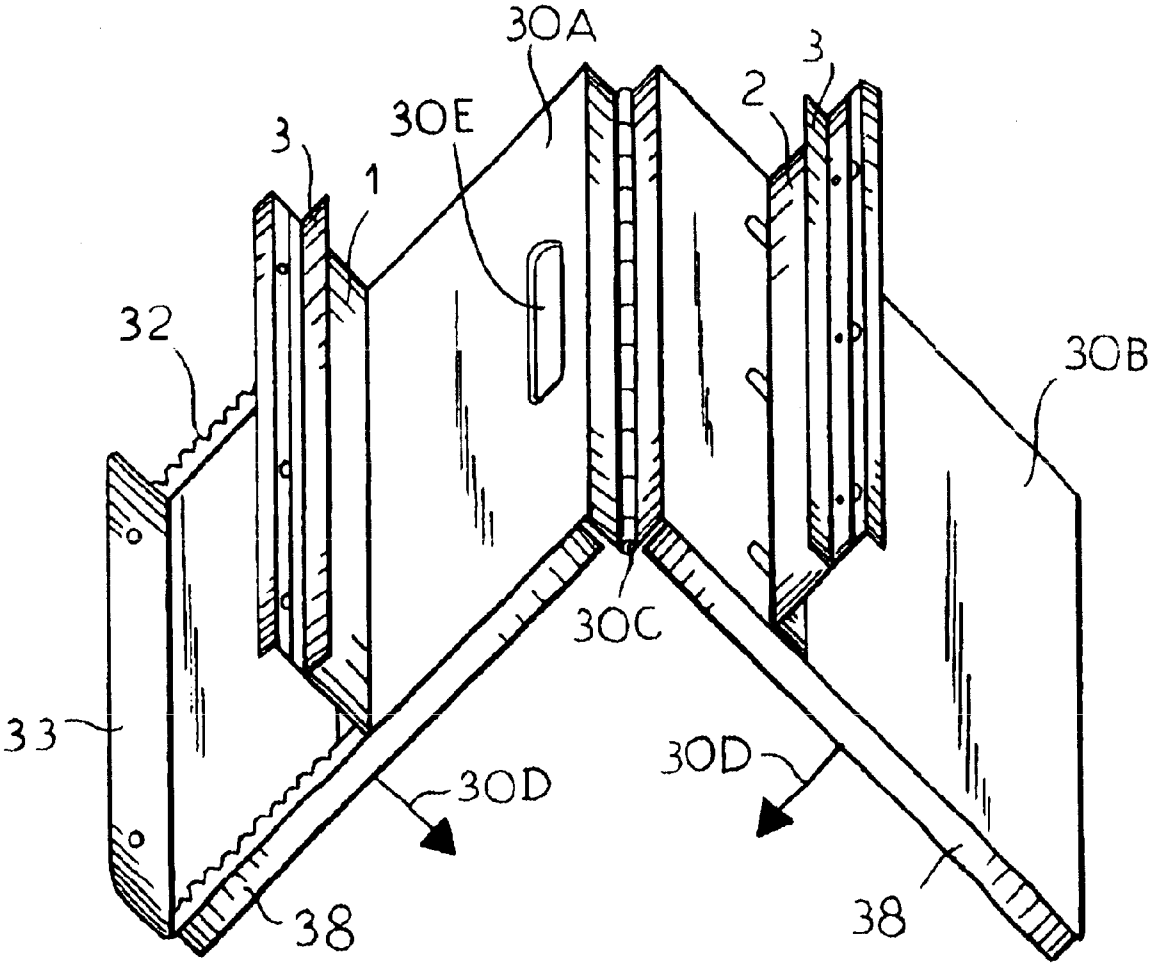
FIG. 5 is a perspective view showing the hinge of the folding tray.

The workstation of the invention is represented at 30 and comprises two tray halves 30A and 30B (FIG. 4) which are joined by a hinge 30C to allow the two halves 30A and 30B to be folded toward one another (arrows 30D in FIG. 5). The hand slot 30E in the half 30A will allow the folding tray to be engaged in its folded position by the user and transported with ease. The entire article (best seen in FIGS. 4 and 5) may be composed of aluminum although other appropriate materials like plastic or wood may be used.

Figure 2:
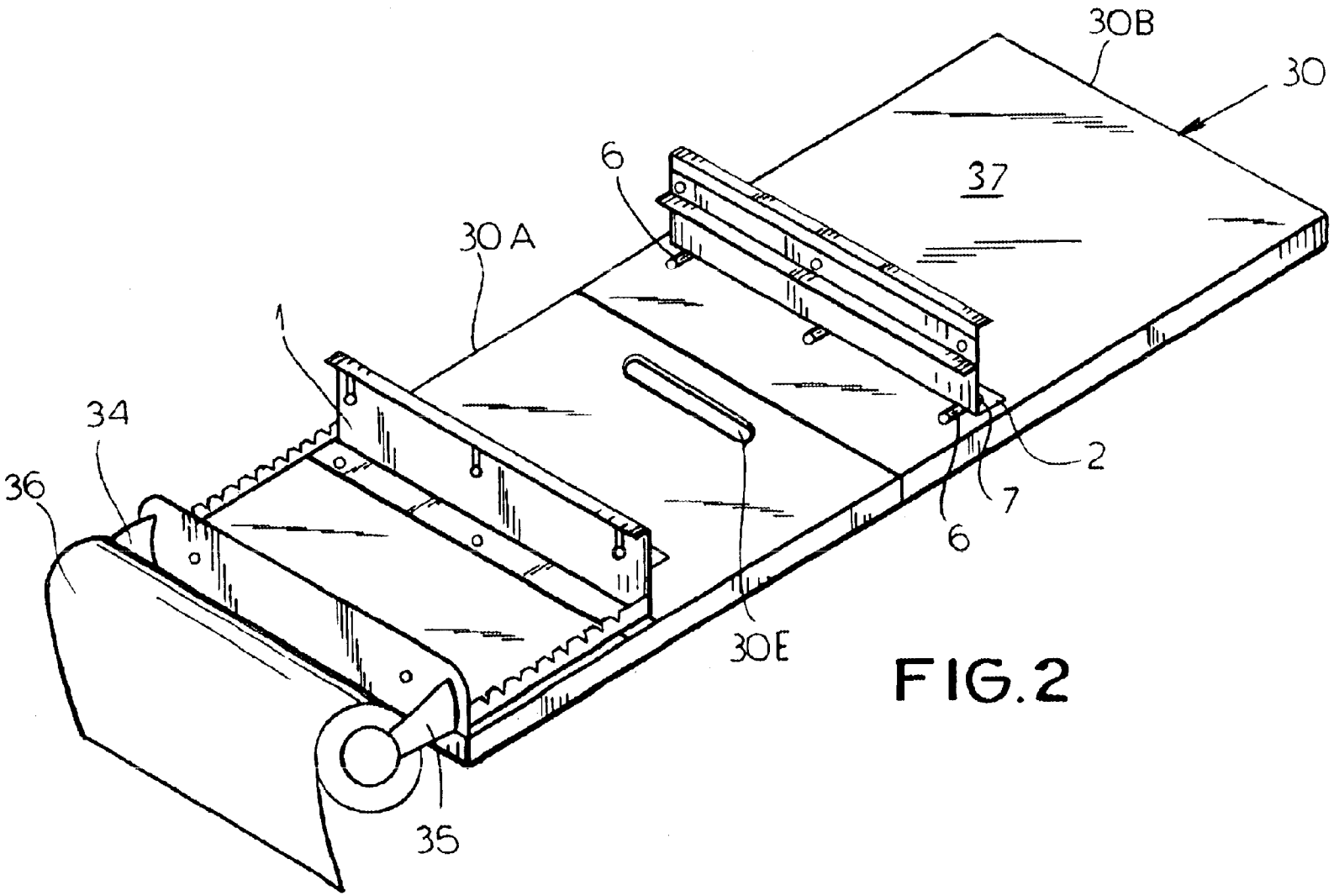
FIG. 2 is a perspective view of the workstation in its open position.
Figure 3:
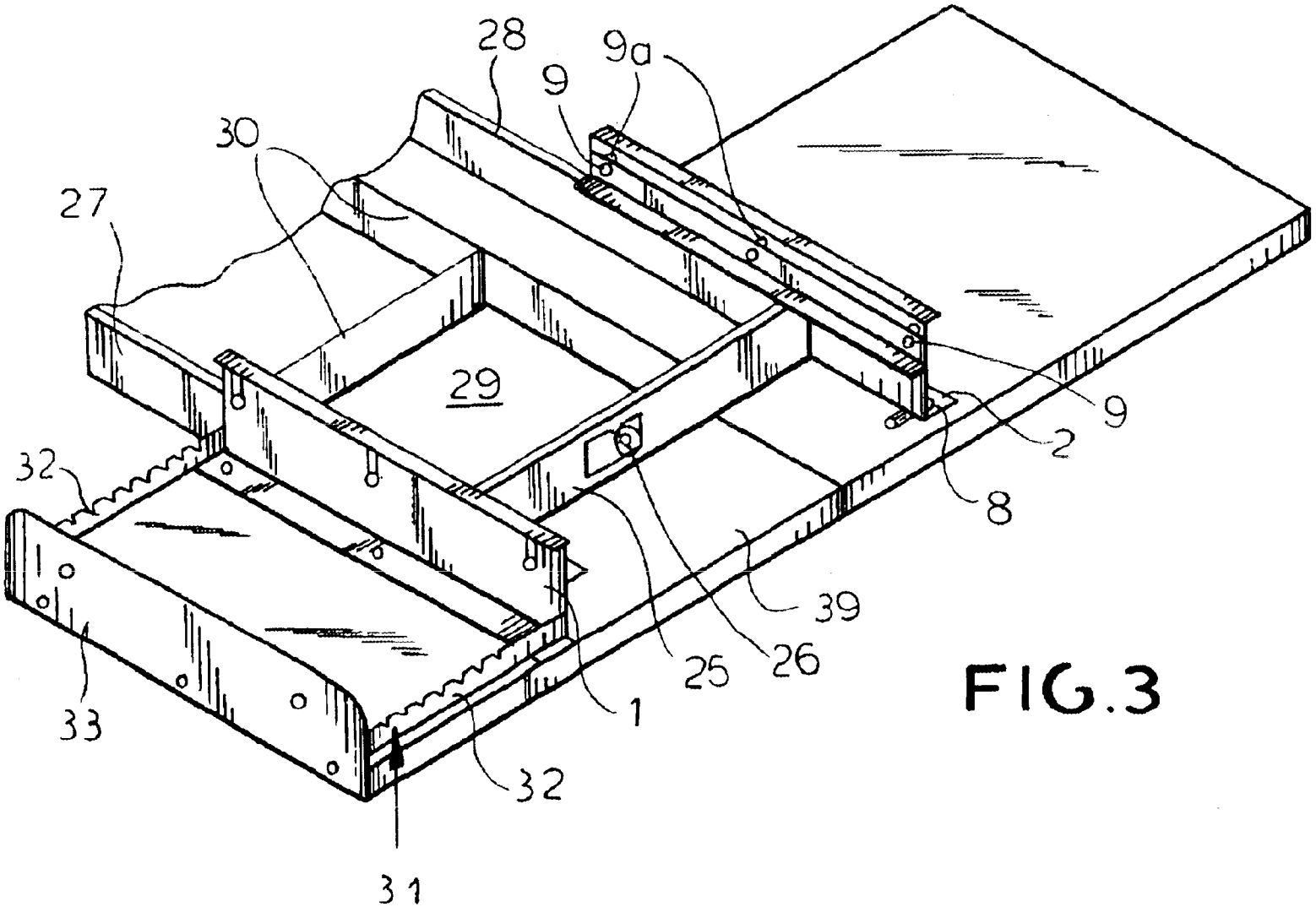
FIG. 3 is a view similar to FIG. 2 showing the mounting of the workstation on a drawer of the easel.

As can be seen from FIGS. 1, 2 and 3, the halves 30A and 30B of the fordable tray 30 can be opened into a flat configuration with the parts 30A and 30B being coplanar and so that slides 1 and 2, mounted on the two halves, can laterally engage the sides 27 and 28 of the drawer with respective ledges 3 overhanging the drawer sides 27 and 28. The drawer thud holds the tray in its open position and allows the tray to be slid onto the drawer so as to underlie the drawer and thereby prevent obstruction of access to the interior of the drawer. At least one of the slides, e.g. slide 2 is adjustable toward and away from the other slide 1 by means of slotted holes 6 formed in the half 30B and screws which engage through those slotted holes and a flange 7 of the slide 2. A head of such a screw is visible at 8 in FIGS. 3 and 4.

The ledges 3 may be vertically adjustable on the slides 1 and 2 by screws 9 which pass through slotted holes 9*a* in the respective slides.

In addition, the slide 1 may form part of a brush holder 31 formed by a pair of v-notched racks 32 so that between the slide 1 and a flange 33 affixed to the racks 32, there is a space accommodating brushes 4, if desired, and other paraphernalia.

The flange 33 may also form a paper towel holder, in which case a pair of arms 34 and 35 may grip a roll 36 of paper toweling between them.

After being mounted upon the drawer, a surface 37 of the attachment is available to accommodate the artist's palette.

Among the advantages of the folding trays of the invention is that it is reversible for right or left-handed users, can fold to a comparatively small size for storage and transport and when folded, because of the turned edges 38 of the sheet metal halves, can provide a space for a palette, a drawing pad or the like. When in place the unit does not obstruct access to the drawer contents and, if desired, the unit can form a shelf 39 in front of the drawer to accommodate other artist's items.

With the workstation in place on the drawer, a small drawing board, palette, or the like can be rested across the bent top of slides 1 and 2.

Figure 6:
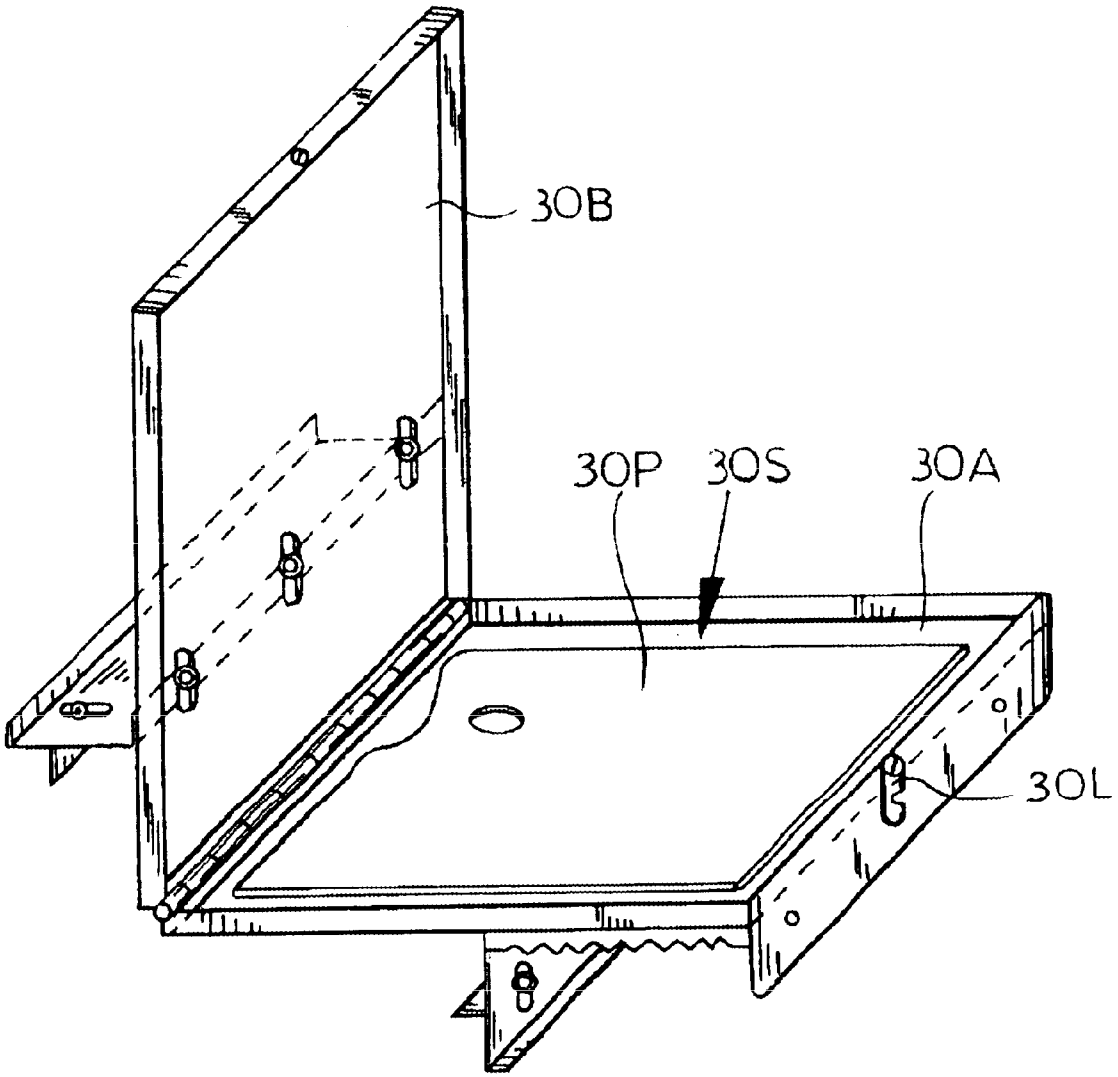
FIG. 6 is a perspective view showing the underside of the tray.

As can be seen from FIG. 6, the undersides of the trays can form a storage compartment 30S which can be held closed by a latch 30L to accommodate a palette 30P, drawing pads or other artists' equipment.

I claim:

1. A box-type portable French easel comprising:

a box-shaped casing;

a plurality of folding legs mounted on and extendable from said casing for supporting said casing upon a surface;

an artwork support structure mounted on and erectable from said casing for supporting an artist's work surface;

a drawer receivable in said casing and extendable therefrom in a direction transverse to said work surface and toward a user of the easel, said drawer having a pair of longitudinal sides extending in said direction; and a workstation attachment for said easel comprising:

an elongated tray dimensioned to extend below said drawer and beyond said sides, and a pair of slides on said tray engaging said sides of said drawer and supporting said tray on said drawer, each of said slides having a plate secured to said tray and flanking a the respective side of said drawer, and a ledge projecting inwardly from the respective plate and engaging over an edge of the respective drawer side.

2. The portable easel defined in claim 1, further comprising a combination brush rack, paper towel holder and surface for artist's materials on one end of said tray to one side of said drawer, another end of said tray to an opposite side of said drawer forming a palette-receiving surface.

3. A box-type portable French easel comprising:

a box-shaped casing;

a plurality of folding legs mounted on and extendable from said casing for supporting said casing upon a surface;

an artwork support structure mounted on and erectable from said casing for supporting an artist's work surface;

a drawer receivable in said casing and extendable therefrom in a direction transverse to said work surface and toward a user of the easel, said drawer having a pair of longitudinal sides extending in said direction; and a workstation attachment for said easel comprising:

an elongated tray dimensioned to extend below said drawer and beyond said sides, and a pair of slides on said tray engaging said sides of said drawer and supporting said tray on said drawer, comprising said tray having a combination brush rack, paper towel holder and surface for artist's materials on one end of said tray to one side of said drawer, another end of said tray to an opposite side of said drawer forming a palette-receiving surface, said tray having two parts forming opposite ends.

4. The portable easel defined in claim 3 wherein said tray is formed with a plurality of slots extending transversely to said direction, one of said slides having screws extending through said slots to permit adjustment of the respective slide to vary said distance.

5. The portable easel defined in claim 4 wherein said slides are adjustable to vary a distance between them in accordance with a width of said drawer.

6. The portable easel defined in claim 5, further comprising means for adjusting heights of said slides to accommodate drawer sides of different heights.

7. The portable easel defined in claim 6 wherein said tray forms a shelf located forwardly of a front of said drawer for accommodating artist's articles.

8. The portable easel defined in claim 7 wherein said parts of said tray define a storage space for artist's materials when folded together and latched.

9. A workstation attachment for a box-type portable French easel having a drawer adapted to be pulled out from a frame, said drawer having opposite sides, said workstation attachment comprising:

an elongated tray dimensioned to extend below said drawer and beyond said sides, and a pair of slides on said tray engaging said sides of said drawer and supporting said tray on said drawer, and a brush rack mounted on one end of said tray to one side of said drawer, another end of said tray to an opposite side of said drawer forming a palette-receiving surface, said tray having two parts forming opposite ends thereof and articulated together by a hinge.

10. The workstation attachment defined in claim 9 wherein said slides are adjustable to vary a distance between them in accordance width a width of said drawer.

11. The workstation attachment defined in claim 10, further comprising means for adjusting heights of said slides to accommodate drawer sides of different heights.

12. The workstation attachment defined in claim 4 wherein said parts of said tray define a storage space for artist's materials when folded together and latched.

* * * * *